US009376173B2

(12) United States Patent
McEvoy

(10) Patent No.: US 9,376,173 B2
(45) Date of Patent: Jun. 28, 2016

(54) MARINE VESSEL TOWING ASSEMBLY

(71) Applicant: Edward Raymond McEvoy, Colville, WA (US)

(72) Inventor: Edward Raymond McEvoy, Colville, WA (US)

( * ) Notice: Subject to any disclaimer, the term of this patent is extended or adjusted under 35 U.S.C. 154(b) by 0 days.

(21) Appl. No.: 14/505,174

(22) Filed: Oct. 2, 2014

(65) Prior Publication Data

US 2016/0096594 A1 Apr. 7, 2016

(51) Int. Cl.

| | |
|---|---|
| ***B63B 21/56*** | (2006.01) |
| ***B63B 21/58*** | (2006.01) |
| ***B21D 53/10*** | (2006.01) |

(52) U.S. Cl.

CPC ..... *B63B 21/56* (2013.01); *B21D 53/10* (2013.01); *B63B 21/58* (2013.01)

(58) Field of Classification Search

USPC ..... 114/253

IPC ..... B63B 21/56,21/58; B21D 53/10

See application file for complete search history.

(56) References Cited

U.S. PATENT DOCUMENTS

| | | | | | |
|---|---|---|---|---|---|
| 1,968,577 | A * | 7/1934 | Taylor | B63H 25/04 | 114/162 |
| 3,911,850 | A * | 10/1975 | Baer | B63B 21/58 | 114/252 |
| 5,725,229 | A * | 3/1998 | McWethy | B60D 1/06 | 280/416.1 |

* cited by examiner

*Primary Examiner* — Stephen Avila
(74) *Attorney, Agent, or Firm* — Ingrid McTaggart

(57) ABSTRACT

A marine vessel towing assembly includes a tow pin assembly housing including therein a self-contained horizontal roller cartridge, a self-contained vertical pin cartridge, and a self-contained hook cartridge, the tow pin assembly housing defining a clear path of removal for each self-contained cartridge from the tow pin assembly housing such that removal of each self-contained cartridge is conducted with an absence of contact with remaining self-contained cartridges of the tow pin assembly housing.

19 Claims, 15 Drawing Sheets

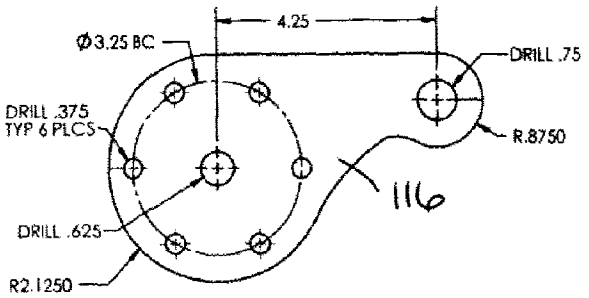
FIG 12C
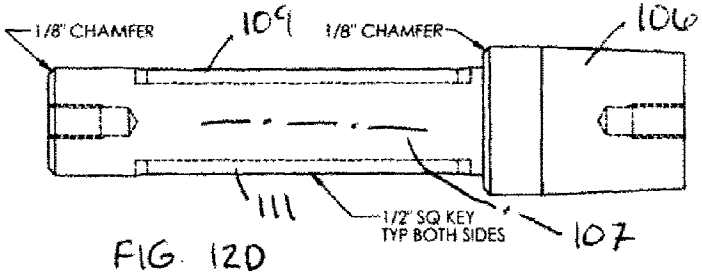
FIG. 12D
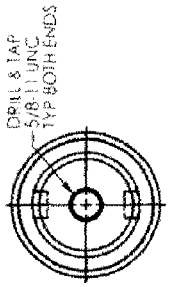
FIG 12F
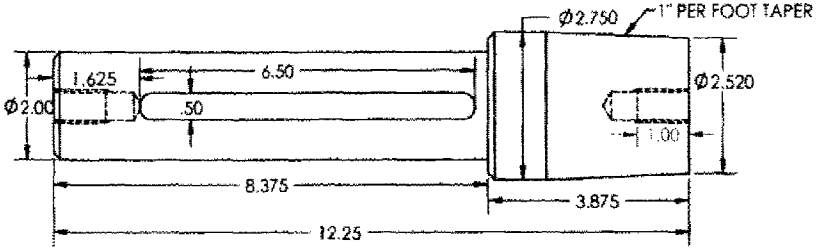
FIG 12E
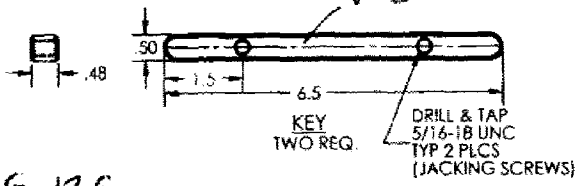
FIG. 12G
FIG. 12H

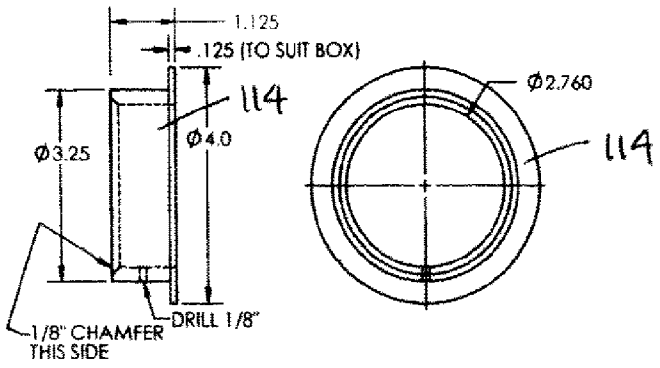
FIG. 12 I
FIG 12 J
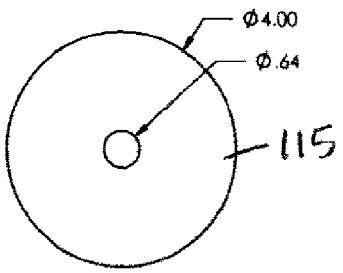
FIG. 12 M
FIG. 12K
FIG. 12L
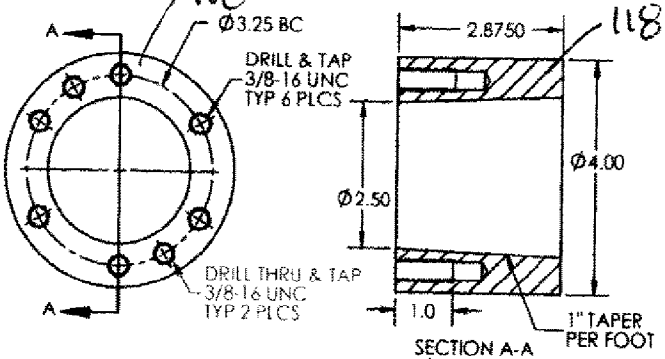
FIG. 12N
FIG. 12O
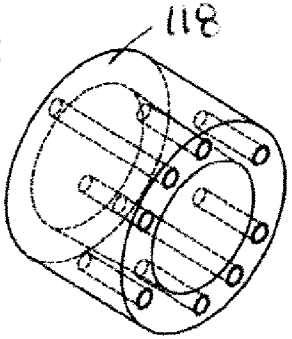
FIG. 12P

MARINE VESSEL TOWING ASSEMBLY

TECHNICAL FIELD

The present invention relates to a pin, roller and hook assembly of which the purpose is to guide and trap a wire used to connect a towing vessel with its tow. More particularly the present invention uses material and design features that improve the manufacturing process, make it less susceptible to damage, create improved accessibility to components for inspection and repair and improve the reliability and performance of the invention in its intended service.

BACKGROUND OF THE INVENTION

Towing astern in a marine environment is a towing mode in which the towing vessel is connected to its tow by a rope or wire that is stowed on a winch on the deck and terminates at a connection to the tow. Prior art tow pin assemblies are difficult to repair and result in wear and tear on the towing rope or wire.

There is a need for a tow pin assembly that facilitates ease of repair and that reduces wear and tear on a towing rope or wire.

SUMMARY OF THE INVENTION

The present invention is particularly intended for use on vessels that tow astern, and in particular, relates to a towing mechanism in which the towing vessel is connected to its tow by a rope or wire that is stowed on a winch on the deck and terminates at a connection to the tow. The tow pin and stern roller assembly of one example embodiment (referred to as the "tow pin assembly") consist of a horizontal roller, multiple vertical rollers (tow pins) and a hook assembly that are supported by a steel structure (tow pin box).

BRIEF DESCRIPTION OF THE DRAWINGS

FIG. 12C shows a side view of an example embodiment of a tow hook assembly arm.

FIG. 12D shows a side view of an example embodiment of a tow hook assembly shaft.

FIG. 12E shows a plan view of an example embodiment of a tow hook assembly shaft.

FIG. 12F shows an end view of an example embodiment of a tow hook assembly shaft.

FIG. 12G shows an end view of an example embodiment of a tow hook assembly jacking screw.

FIG. 12H shows a side view of an example embodiment of a tow hook assembly jacking screw.

FIG. 12I shows a side view of an example embodiment of a tow hook assembly large bushing.

FIG. 12J shows an end view of an example embodiment of a tow hook assembly large bushing.

FIG. 12K shows a side view of an example embodiment of a tow hook assembly small bushing.

FIG. 12L shows an end view of an example embodiment of a tow hook assembly small bushing.

FIG. 12M shows a plan view of an example embodiment of a tow hook assembly shaft end plate.

FIG. 12N shows a plan view of an example embodiment of a tow hook assembly shaft hub.

FIG. 12O shows a side cross sectional view of an example embodiment of a tow hook assembly shaft hub.

FIG. 12P shows an siometric view of an example embodiment of a tow hook assembly shaft hub.

DETAILED DESCRIPTION OF PREFERRED EMBODIMENTS

Figure 1:
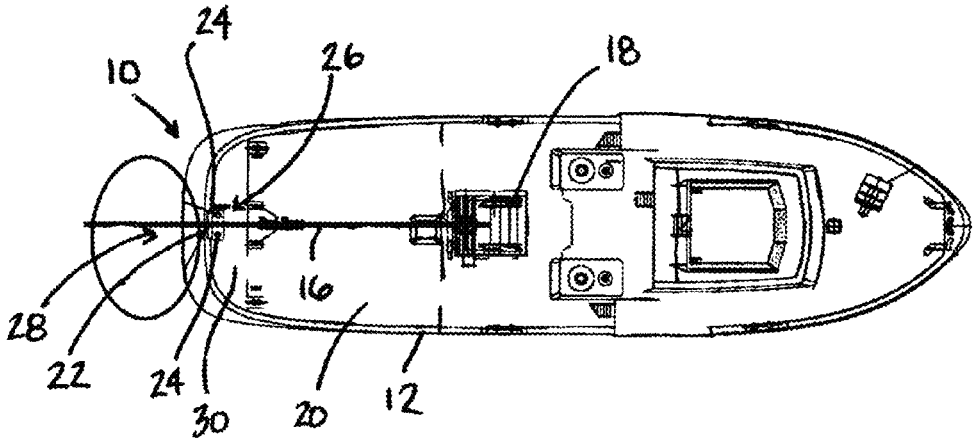
FIG. 1 is a plan view of a marine towing vessel, including one example embodiment of a marine vessel tow pin assembly.
Figure 2:
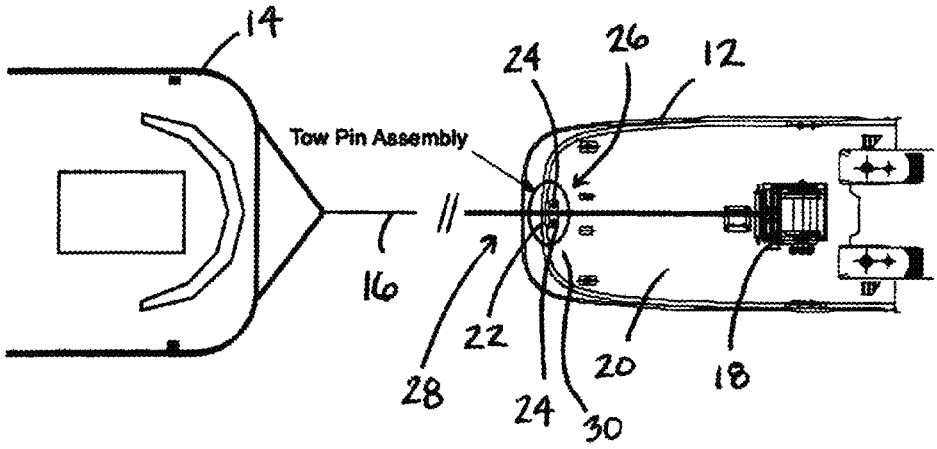
FIG. 2 is a plan view of a marine tow vessel, including one example embodiment of a tow pin assembly, towing a towed marine vessel.

The invention will now be described with reference to the drawings. The present invention is particularly intended for use on vessels that tow astern, and in particular, relates to a towing mechanism 10, also referred to as a tow pin and stern roller or tow pin assembly, in which the towing vessel 12 is connected to its towed vessel 14 by a rope or wire 16 that is stowed on a winch 18 on the deck 20 and terminates at a connection to the tow (FIG. 1 and FIG. 2). The tow pin and stern roller assembly 10 of one example embodiment (referred to as the "tow pin assembly") consist of a horizontal roller 22, multiple vertical rollers (tow pins) 24 and a hook assembly 26 that are supported by a steel structure (tow pin box) 28 (FIG. 4A and FIG. 4B).

The tow pin assembly 10 of the present invention may be welded in a manner that integrates the assembly into the supporting steel structure 30 of the towing vessel 12. The tow pins 24 and hook 26 are raised and lowered as necessary by hydraulic rams mounted inside the tow pin box 28. The tow pin assembly 10 must be strong enough to withstand the forces transferred through the tow wire 16 that result from external forces generated by the thrust of the vessel, the action of both the towed vessel 14 and towing vessel 12 in a seaway and the horizontal pressures generated when the towed vessel is not directly behind the towing vessel's centerline. The combination of these forces can exceed the breaking strength of the tow wire 16.

The tow pin assembly 10 serves multiple functions: reduces tow wire wear; extends tow wire working life; and traps the tow wire 16 on the vessels stern which: shifts the towing vessels towing point aft; creates a safer work environment for crewmembers; and reduces the probability of the towing vessel gifting. Each of these features will be addressed in turn.

Reduction of tow wire wear: The tow pin assembly 10 reduces abrasion and wear on the tow wire 16 as it is being paid out, hauled in or laying in a static position during the voyage. Friction and acute bending angles can produce excessive and premature wire fatigue and will weaken the critical tow wire connection between the towing vessel and the vessel being towed. The stern roller 22 and tow pins 24 must be able to rotate under load in order to enable the tow wire 16 to roll over the bearing surfaces of the pins and roller rather than rub and abrade during these operations. The tow pins and rollers should be constructed in a manner that allow the tow pin sleeve and stern roller to rotate under a wide range of loads and speeds associated with towing operations.

Another source of abrasion is the horizontal and vertical movement of the tow wire 16 when the tow wire has been paid out to the desired length and the towing vessel is underway with its tow. While engaged in towing astern the towing vessel's stern will move vertically and horizontally due to the vessels yaw, pitch and roll actions in a seaway. The tow wire will move independently of the towing vessel's action and will abrade on the towing vessel contact surfaces unless restrained or provided with chafing gear. The tow pin assembly design of the present invention is intended to minimize abrasion from this movement. The space between the vertical tow pins is slightly more than the tow wires diameter minimizing horizontal movement. A tow hook 26 is designed to trap the tow wire and prevent abrasion from vertical movement.

Tow wire fatigue and subsequent weakening can be induced if the tow wire is bent at acute angles when under load. The tow pin and stern roller assembly fairlead the wire through bearing surfaces of a diameter sufficient to reduce wire fatigue due to sharp bends.

Extending Working Life of the Tow Wire: The tow pin assembly 10 lengthens the working life of the tow wire 16 by reducing abrasion and wire fatigue due to excess bending. The useful life of a tow wire averages 15,000 working hours, or several years, depending on the towing application. Acute bending angles or abrasive conditions can seriously damage the tow wire in a matter of hours. Tow wires must be continuous and cannot be spliced. If the tow wire is damaged it is either trimmed back in order to remove the damaged section or discarded completely. The tow pin and stern roller assembly 10 of the present invention help prevent premature damage and failure of the tow wire 16.

Trapping the tow wire: An additional purpose of the tow pin assembly 10 is to hold the tow wire 16 in a fixed position on the towing vessel's stern. Trapping the tow wire at a location on the stern of the towing vessel makes the operation of towing astern safer. The tow pin assembly, when functioning correctly, traps the tow wire and shifts the towing point to the stern. The towing point is the last physical point on the tug that fairleads the tow wire from the towing vessel to the vessel being towed. A towing point on the stern has several benefits.

Safety of the crew: The safety of the crew is facilitated by preventing tow wire movement while crewmen are working on the aft deck. Crewman are called to work on the aft deck during towing operations to make tow, break tow and conduct regular inspection and maintenance of the aft deck area. The tow pin assembly 10 of the present invention traps the tow wire 16, minimizing its movement between the towing vessel's tow winch and stern which helps prevent crewman from being struck by unexpected movements of the tow wire.

Girting: Girting is a term used to describe the scenario in which the strain on the tow wire causes the towing vessel 12 to capsize. Factors that contribute to girting are location of the towing vessel's towing point, heeling angle, hull resistance, propulsion and steering forces, and the direction and force of the towline. In simple terms a towline strain of sufficient force can overcome the towing vessel's inherent stability and cause the towing vessel to capsize. A common cause of this event is when the towing point is located near amidships on the towing vessel (e.g., at the tow winch) and an unexpectedly high towline strain occurs off to one side or the other.

The tow pin assembly 10 reduces the likelihood of this catastrophic event by shifting the towing point to a low point at the vessels stern. If a girting situation were to develop the force of the towline will tend to turn the towing vessel 12 in line with the strain rather than pull it over sideways. This feature is critical to vessel and crew safety in towing astern operations.

Figure 3:
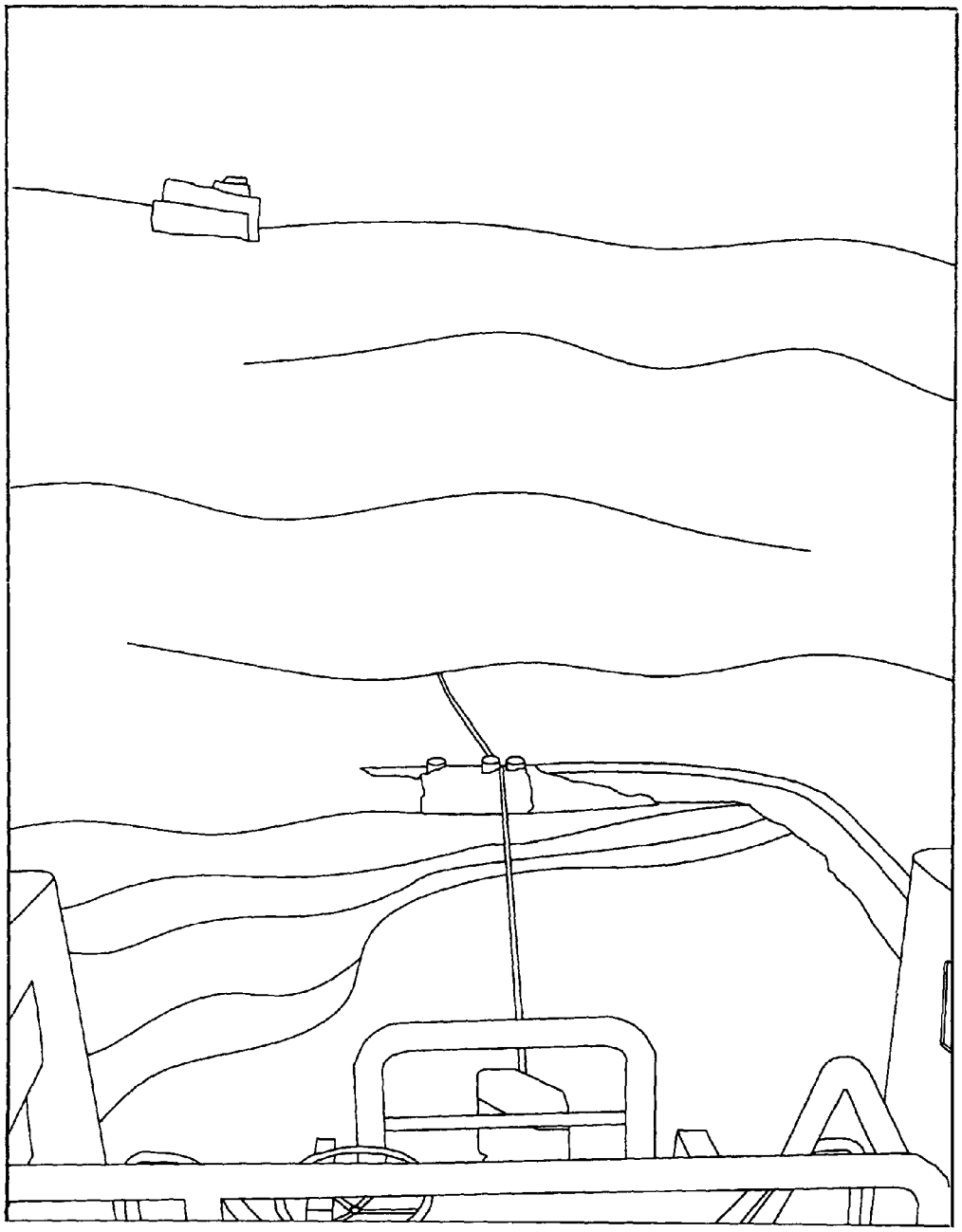
FIG. 3 shows a towed vessel in a marine environment.

The tow pin assembly 10 is a critical piece of equipment in towing astern operations. It should be constructed in a manner that withstands the high dynamic loads, constant exposure to salt water, sea spray (FIG. 3) and has a high degree of reliability. It should be constructed in a manner that facilitates inspection, refurbishment and renewal of components.

The present invention provides an improved tow pin assembly 10 and a process for manufacturing same that overcomes the disadvantages of prior art. The present invention is constructed in a manner in which each major component is an independent cartridge assembly that can be inspected, serviced and repaired without the extensive disassembly and remanufacturing required of prior art. In addition, the present invention uses a unique design and construction materials that improve the strength, reliability and longevity of the present invention compared to prior art.

Figure 4C:
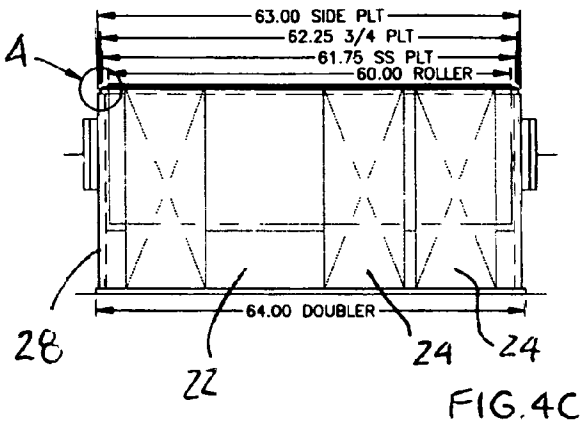
FIG. 4C shows a front view of one example embodiment of a tow pin assembly.
Figure 4D:
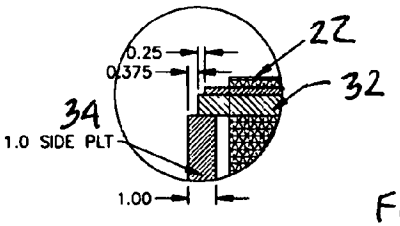
FIG. 4D shows a details of a portion of a tow pin assembly.
Figure 4A:
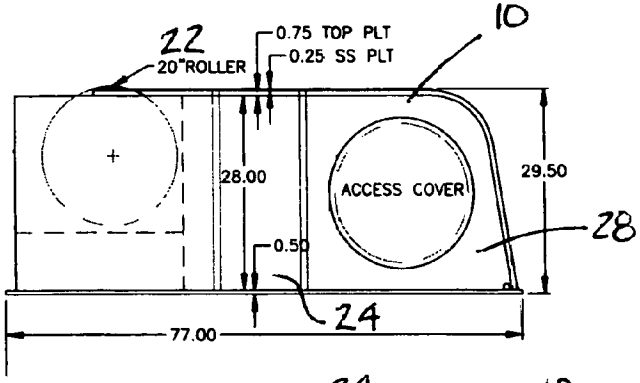
FIG. 4A shows a side view of one example embodiment of a tow pin assembly.
Figure 4B:
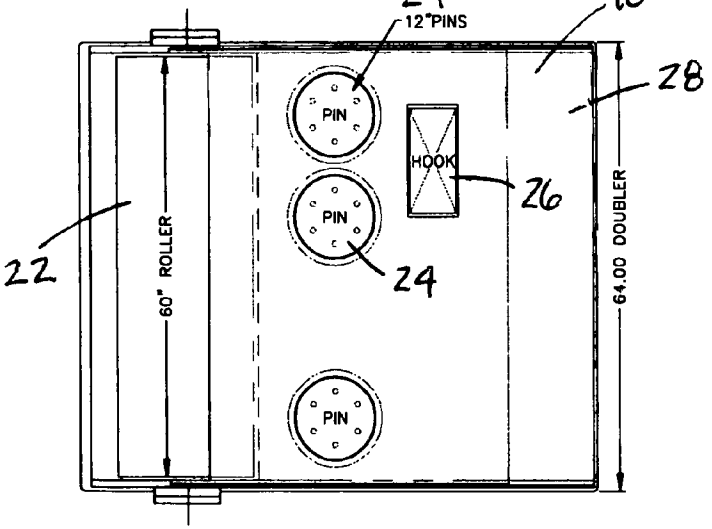
FIG. 4B shows a plan view of one example embodiment of a tow pin assembly.

FIGS. 4A-D show one example embodiment of a tow pin assembly 10. FIG. 4A shows a side view of the tow pin assembly with the vertical pins 24 and the hook assembly 26 retracted downwardly into the tow box 28. FIG. 4B shows a plan view of the tow box 28. FIG. 4*c* shows a front view of the tow box 28 with the vertical rollers 24 and the hook assembly 26 retracted downwardly into the tow box 28. FIG. 4D shows a detail of the area 4 of FIG. 4C. The detail shown in FIG. 4D shows roller 22 extending upwardly above a top plate 32 of tow box 28 and inwardly of a side plate 34 of tow box 28.

Figure 5B:
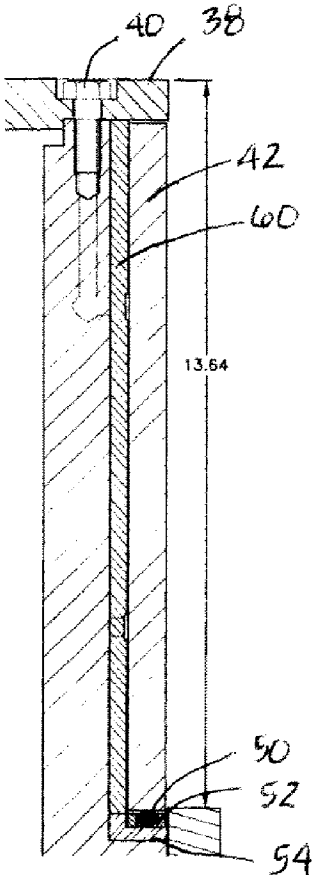
FIG. 5B shows a detailed view of an example embodiment of a tow pin.
Figure 5A:
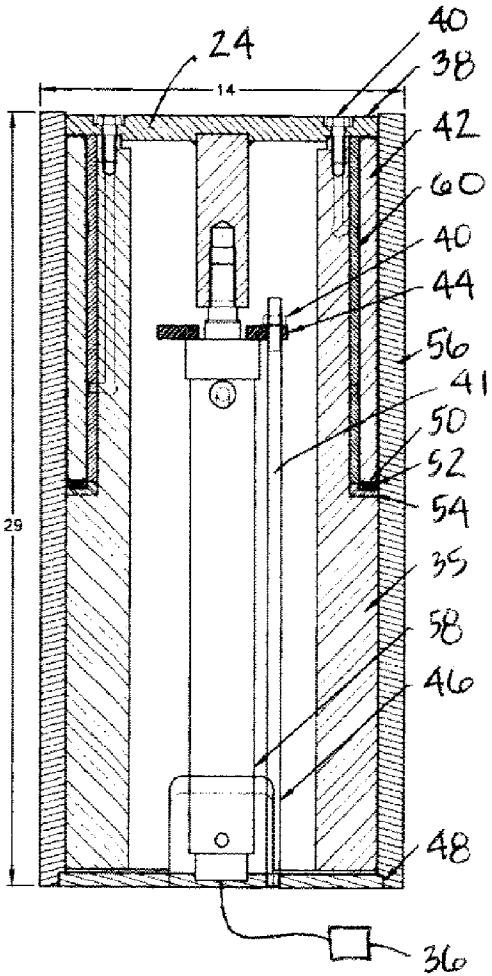
FIG. 5A shows a side cross sectional view of an example embodiment of a set of tow pins.

FIGS. 5A and 5B show one example embodiment of tow pins 24 (vertical rollers 24), namely 12 inch (12") diameter tow pins, of the present invention. FIG. 5A shows a single tow pin assembly 24. There are two additional, identical tow pins 24 in the tow pin assembly 10. Each tow pin 24 consists of a pop-up pin 35 that is raised and lowered by a hydraulic cylinder 36 (shown schematically). A steel roller sleeve or roller 42 is inserted over the pop-up pin and provides the bearing surface for the tow wire. Each tow pin includes a roller top plate 38, that is threaded onto the hydraulic lifting ram, caps the roller 42 and is secured by ½" stainless recessed bolts, such as fastener 40. that connects to the pop-up pin 35. A top plate 44 secures the hydraulic cylinder 36 to the three cylinder mount rods 46 secured to the bottom plate 48. The bottom of the roller 42 rests on ball bearings 50 in a cage 52 and a wear ring 54. A stainless bottom plate 48 serves as the foundation of the tow pin and a receiver for the outer tube 56.

In the present invention, the top plate 38 and threaded connecting rods 46 are manufactured of stainless steel for durability, strength, corrosion resistance, and ease of disassembly for refurbishment or renewal. The prior art does not have a top plate or threaded rods but uses a clevis pin arrangement on the bottom end and the top is threaded into a steel receiver. The prior art structures are more exposed to corrosive effects and become more difficult to access and disassemble for refurbishment or renewal. The roller top plate 38 is manufactured of stainless steel. The prior art uses a roller top plate fabricated from mild steel which is less resistant to corrosion. The bottom of the roller 42 rests on 5/16" stainless ball bearings 50 contained in a bronze cage 52. This provides an extra bearing surface, not found in prior art, that enhances the ability of the tow pin to rotate and reduces wear on the bottom end of the roller. This extends the life of the tow pin assembly. In addition, the bearing cage 52 is supported underneath by a stainless wear ring 54 that provides an expendable wear surface. When excessive wear is evident the pop pin no longer maintains a true vertical position and wobbles when rotating. The present invention allows easy removal of the pop-up pin assembly from the tow pin assembly 10 and simple replacement of the stainless wear ring rather than the extensive disassembly and repair required by prior art. The prior art does not provide a mechanical bearing surface for the bottom of the roller. The bottom of the roller is a steel on steel interface. The bottom of the prior art roller is prone to galling causing a buildup of material using up all the clearance resulting in the roller not turning freely. In prior art devices, when the bottom becomes worn the whole roller must be replaced. During use of the present, one only has to replace the stainless wear ring 54 and bearings 50.

The hydraulic cylinder 58 that lifts and retracts the pop-up pin is secured in place on the bottom by a locating socket in the bottom of the cylinder, three stainless steel threaded rods 46 with stainless nuts and a stainless steel top plate 44. This allows access to the hydraulic ram assembly from the top and facilitates ease of manufacturing and repair. If the component needs refurbishment or renewal the roller top plate is unbolted and removed, the three stainless steel nuts on the threaded rods removed and the hydraulic cylinder pulled out from the top. The prior art does not use this design for securing the hydraulic ram. The prior art uses a mild steel clevis and pin arrangement to secure the bottom of the hydraulic cylinder and does not have threaded rods to provide vertical support. The mild steel clevis and pin is subject to corrosion and seizing. In order to remove the prior art hydraulic ram, the prior art requires disassembly of the roller and pop-up pin in order to access the pin and then subsequent heating with a torch to remove rust and drive the pin out. This prior art repair process usually results in consequential damage to other components adding to the time, cost and scope of repair.

The present invention utilizes a stainless bottom plate 48 as the foundation for the pop pin and roller assembly and serves as the receiver for the outer tube 56. The outer tube is welded at the top to the tow pin box structure. Access and removal of the outer tube for refurbishment or renewal is from the top. The pop-up pin assembly is removed and the weld between the outer tube and tow pin box are carbon arched allowing removal of the outer tube from the top. The prior art design does not have an outer tube. Prior art structures create a tube and foundation for the pop-up pin by using the tow pin box structure. Prior art design do not accommodate refurbishment or renewal of the pop pin tube or foundation without reconstruction of the tow pin box structure.

In the present invention, each pop-pin is equipped with one bronze roller bearing 60 that is full length of the roller and functions as the load bearing surface for the roller. The bearing is shrunk fit to the pop-up pin and greased via grease fittings located on the top of the roller top plate 38 and ⅛" diameter grease channels. The prior art has two bronze bushings, an upper and lower, but none in the middle. The prior art lubricates the roller bushings by grease fittings threaded into recessed holes in the body of the roller. The prior art design grease fitting is susceptible to damage as its location on the roller is an area exposed to bearing of the tow wire and excessive wear. The prior art bushing arrangement produces an "hour glass" effect on the roller with heavy loading in the middle of the roller. Water intrusion is also common in the cavity between the upper and lower bushing. This produces corrosive effect over time and as the bushings wear, contact between the inner wall of the roller and the out wall of the pop-up pin restrict or stop the roller from turning.

In the present invention, the bearing surface between the pop-up pin and the outer tube is lubricated through two ¼" stainless steel tubes that run down the inner wall of the pop-up pin 180 degrees apart. This distributes lubrication over the whole sliding surface. The prior art uses only one lubrication point and does not distribute lubrication over the whole slide surface.

These design and material features of the present invention utilize a "cartridge" design principle so that the pop-up pin, roller and hydraulic cylinder components can be easily manufactured and accessed for refurbishment or renewal. The prior art design does not incorporate a "cartridge" design principle. Access to the pop-up pin, roller and hydraulic cylinder components of the prior art requires extensive and time consuming disassembly and may damage or destroy surrounding unaffected components or structural members.

Figure 6B:
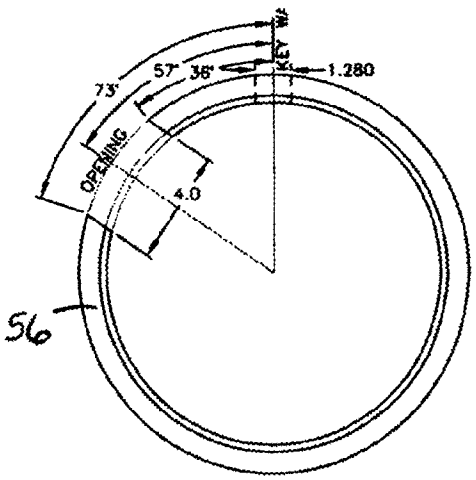
FIG. 6B shows a plan view of an outer tube.
Figure 6A:
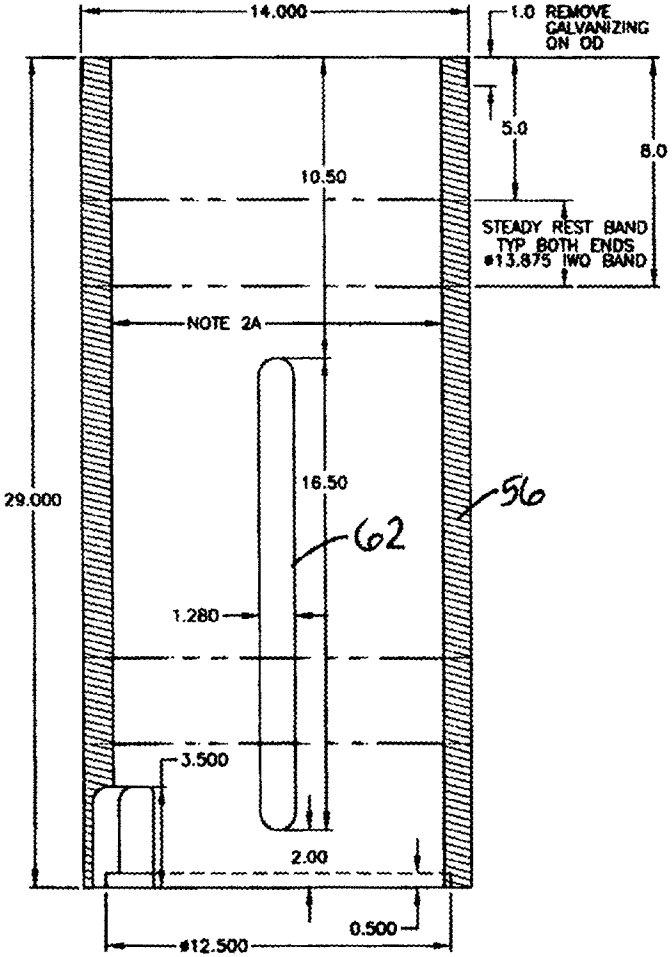
FIG. 6A shows a side cross sectional view of an example embodiment of an outer tube.

FIG. 6A is side cross sectional view of the outer tube 56 illustrating the slotted key way 62 that guides the pop up pin 24 (FIG. 5A) vertically up and down. FIG. 6B is a top view of the outer tube 56.

Figure 7B:
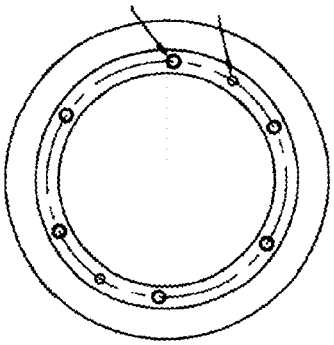
FIG. 7B shows a plan view of an example embodiment of a pop-up pin.
Figure 7D:
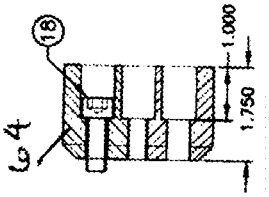
FIG. 7D shows a side cross sectional view of an example embodiment of a key.
Figure 7E:
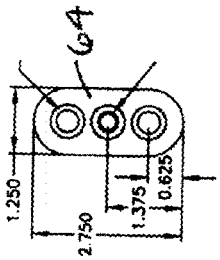
FIG. 7E shows a front view of an example embodiment of a key.
Figure 7C:
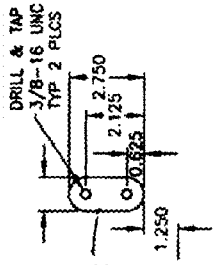
FIG. 7C shows a front view of an example embodiment of a key cutout.
Figure 7A:
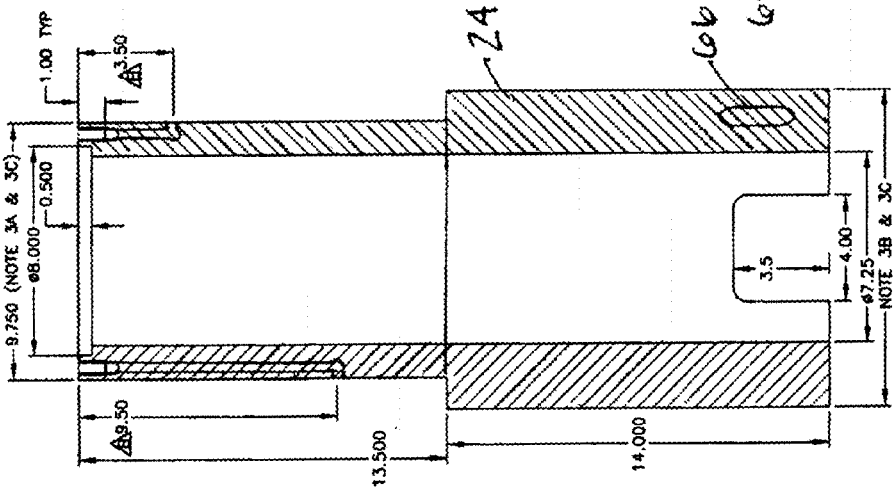
FIG. 7A shows a side cross sectional view of an example embodiment of a pop-up pin and key.

FIG. 7A is cross sectional side view of the pop-up pin 24 and the key 64, received within slot 66 of pop-up pin 24, that rides up and down in the key way 62 of the outer tube 56 (FIG. 6A). FIB. 7B is a top view of the pop-up pin 24. The pop-up pin 24 is equipped with a guide key 64 to track the pin movement in the outer tube key way 62. The present invention guide key pin is manufactured of stainless steel. The prior art utilizes mild steel for a guide pin.

Figure 8:
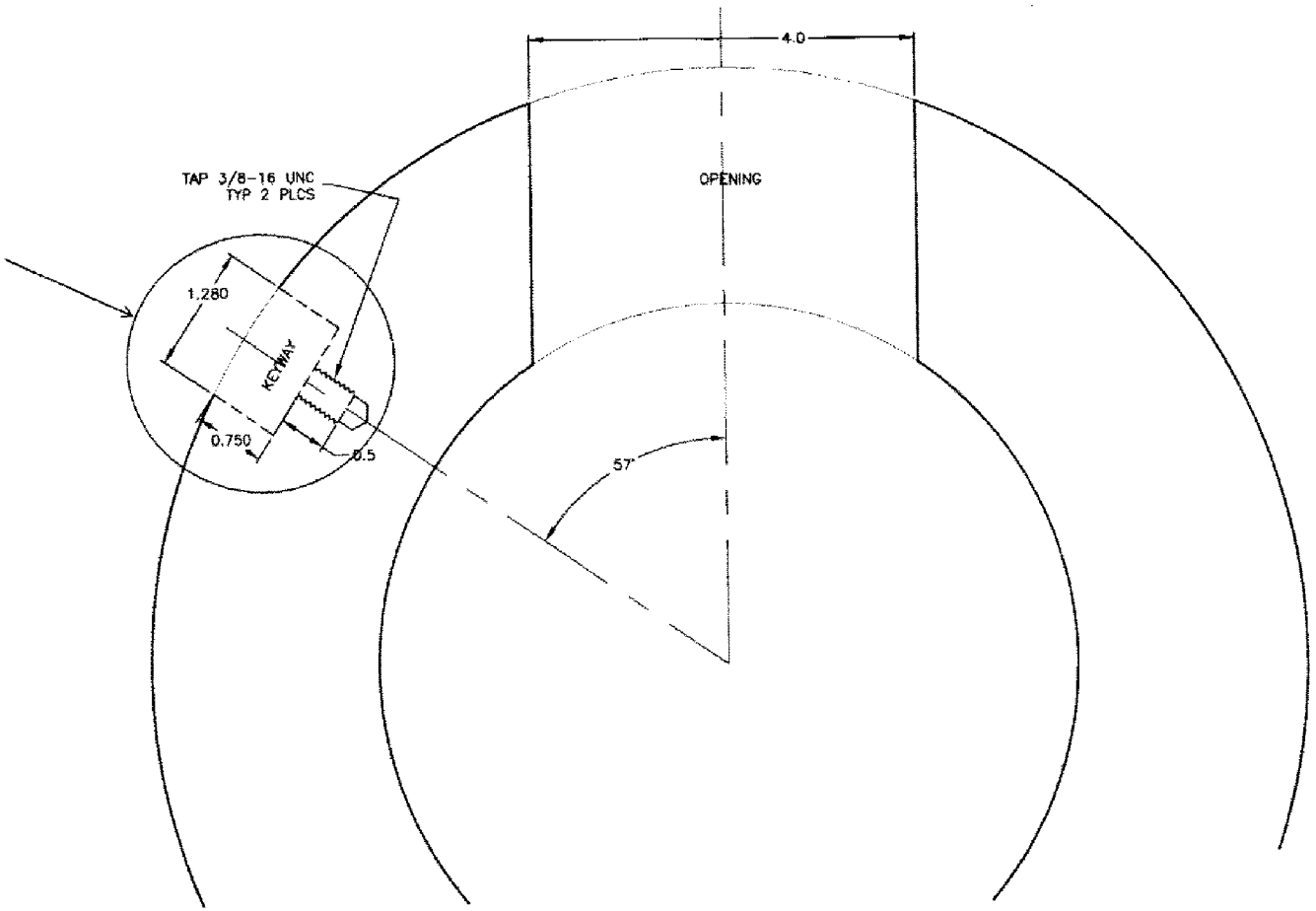
FIG. 8 shows an example embodiment of a pop-up pin template showing guide key detail.

FIG. 8 is a plan view of the top of the pop-up pin illustrating the detail of the keyway 62. The present invention uses a 1¼"

wide by ¾" deep keyway 64. This adds to the reliability of the tow pin assembly and reduces the probability of the pop-up pin rotating. If the pop-up pin 24 rotates due to wear of the guide key there is a high probability that hydraulic lines will be severed and render the pin inoperable. The prior art utilizes a guide key depth of ¼" and has less tolerance for wear and thus reduced reliability in comparison to the present invention.

Figure 9:
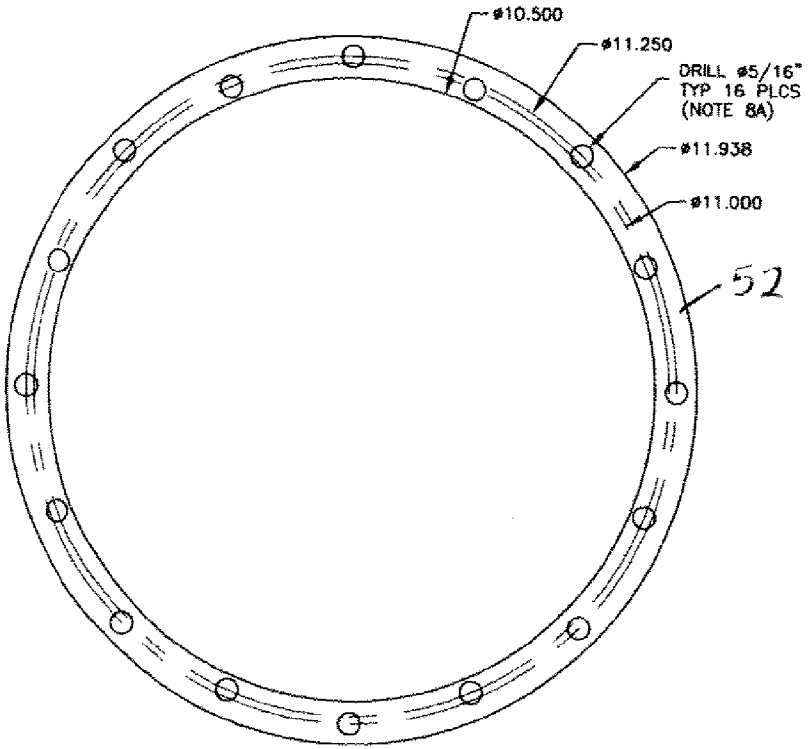
FIG. 9 is a plan view of one example embodiment of a roller bearing cage.

FIG. 9 shows a plan view of the roller bearing cage 52. The present invention uses stainless steel ball bearings 50 mounted in a bronze bearing cage 52 to bear the weight of the roller bottom as it rests on the pop-up pin. Sixteen stainless steel bearings 50 are mounted in a bronze steel bearing cage 52. The bearing pattern is staggered, i.e., the bearings are positioned such that they do not all move in the same path, to increase durability and reduce the friction of the rotating surfaces. In the prior art the bottom of the roller rests on the pop up pin with no mechanical bearing surface. This generates more friction while the roller is turning.

Figures 10A, 10B:
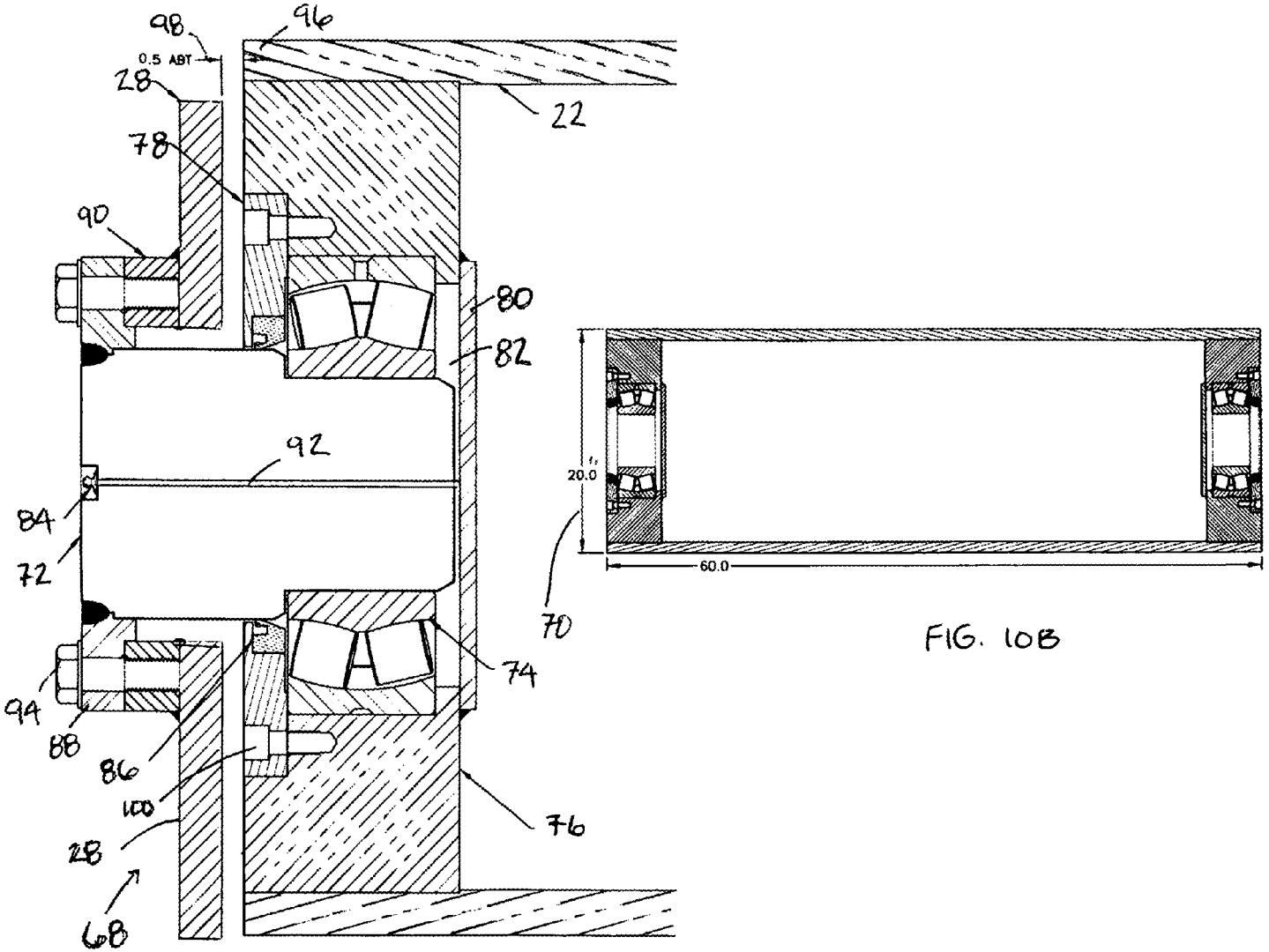
FIG. 10A shows a side cross sectional detailed view of an example embodiment of a stern roller assembly.
FIG. 10B shows a side cross sectional view of an example embodiment of a stern roller assembly.

FIG. 10A shows a side cross sectional view of an end region of horizontal roller assembly 68 that is inset into the towing vessel's bulwarks. FIG. 10B shows the entire stern roller 22. The horizontal or stern roller 22 of assembly 68 is subject to the downward force of the tow wire 16 (FIG. 1) generated by the weight of the tow wire, and external forces such as the thrust of the vessel and the action of both the towed vessel and towing vessel in a seaway. It must be of sufficient diameter 70, such as 20" diameter in the example embodiment shown, to minimize bending stress on the tow wire 16 and to be able to rotate under load.

The stern roller 22 is constructed of a mild steel roller 22 and supported on either end by an axle shaft (roller shaft) 72 and self-aligning bearings 74. The self aligned bearings 74 are inset in the bearing bore 76 and the seal plate assembly 78 retains it in the roller. A ⅜" back seal plate 80 is welded to the backside of bearing insert 76. Once the bearing 74 is inserted, outside seal plate 78 is fastened with stainless fasteners to the bearing bore insert 76. This maximizes the self-aligning performance of the bearings 74. The bearing insert 76 is machined so that an internal cavity 82 is created between the back seal plate 80 and the bearing 74. When grease is applied through the external zerk fitting 84 it fills the internal cavity 82 first, passes through the bearing structure and is forced out the outside seal plate 78, which may be referred to as a front seal plate 78, preventing salt water intrusion into the bearings 74. A seal 86 also acts to retain grease within internal cavity 82.

Accordingly, the present invention uses self aligning bearings 74. The stern roller assembly 68 can be subject to heavy contact with the towed vessel due to human error. The self aligning bearings can accommodate more degree of misalignment than prior art and thus are more durable. An axle shaft on each side of the stern roller is inserted through the side frame of the tow pin box and retained in the stainless 1" register. This prevents shear loading on the retaining bolts. The prior art uses hat bushing pressed in place and then the roller shaft is secured by a bolted bearing cap. Heating and cooling during the manufacturing process makes prior art devices susceptible to misalignment during fabrication. Heavy contact with the towed vessel can also cause the roller to become misaligned in prior art devices. The prior art has little tolerance for misalignment and its ability to rotate freely and function properly will either be restricted or eliminated.

An axle shaft 72 of stainless steel is shrunk fit to a flange plate 88 and then bolted to the register retaining plate (shaft doubler) 90 with stainless fasteners. The register retaining plate (shaft doubler) 90 is welded to the side plate of the tow pin box 28. The advantage of the present invention is that the stern roller can be easily removed by unbolting the flange plate 88, removing the axles and lifting the roller clear of the tow pin box 28. The prior art does not use flange plates but a half-bearing cap principle in which the axle is retained on the lower side by a built-in bearing cap receiver and on the upper side by a half-bearing cap that is secured by steel socket bolts. The disadvantage of the prior art is that the bolts are subject to shear loads and can be easily distorted by roller contact. Removal of the stern roller in the prior art is more difficult and in practice the bolts must be burned off. In addition, the bolts are exposed to damage from the tow wire riding over the top of them.

In the present invention, lubrication to the bearings is through a ⅛" diameter channel 92 rifled through the center of the roller shaft 72. Grease is applied through exterior zerk fitting 84 and fills the inner cavity 82 forcing grease out the retaining seal 86. This prevents salt water intrusion into the bearing 74. The prior art utilizes a bronze hat bushing and is lubricated through a zerk fitting inset into the roller. The zerk fitting of the prior art is inset in an area that the tow wire runs over and is subject to damage. The prior art bushing does not allow the same freedom of rotation as the self-aligning bearings of the present invention and cannot accommodate as much impact on the stern roller as the design of the present invention.

The present invention has a register retaining plate (shaft doubler) 90 that receives the bolts 94 securing the axle shaft/flange assembly to the pin box 28. The register retaining plate 88 absorbs shear loads rather than the flange mounting bolts. Bearing cap bolts utilized by the prior art are exposed to damage or excessive wear when the tow wire or heavy chain comes over the stern roller with either the pins down or has "jumped" the pins and lays outboard of the tow pins.

In the present invention, the gap between the roller edge 96 and the pin box structure 28 is a distance 98 of ½". The present invention creates a smaller gap that reduces the potential for wear on the tow wire. The gap between the stern roller and the cap rail in the prior art is 4-6" in order to accommodate the bearing cap and bolts. This gap is of the prior art is a sufficient width to allow the tow wire to fall in and become damaged.

In the present invention, the bearing insert 76 is machined and heat shrunk fit. Over time the exterior wall of the roller tube 22 is subject to heavy wear in scattered locations of high use. The advantage of the present invention is that when the roller tube requires refurbishment the roller assembly 68 can be removed, the bearing insert 76 retained and re-used while the roller tube is thin walled machined and installed in a pre-machined tube. In the prior art when the exterior wall of a roller tube becomes worn the roller assembly including the axles must be removed and replaced.

Figure 11B:
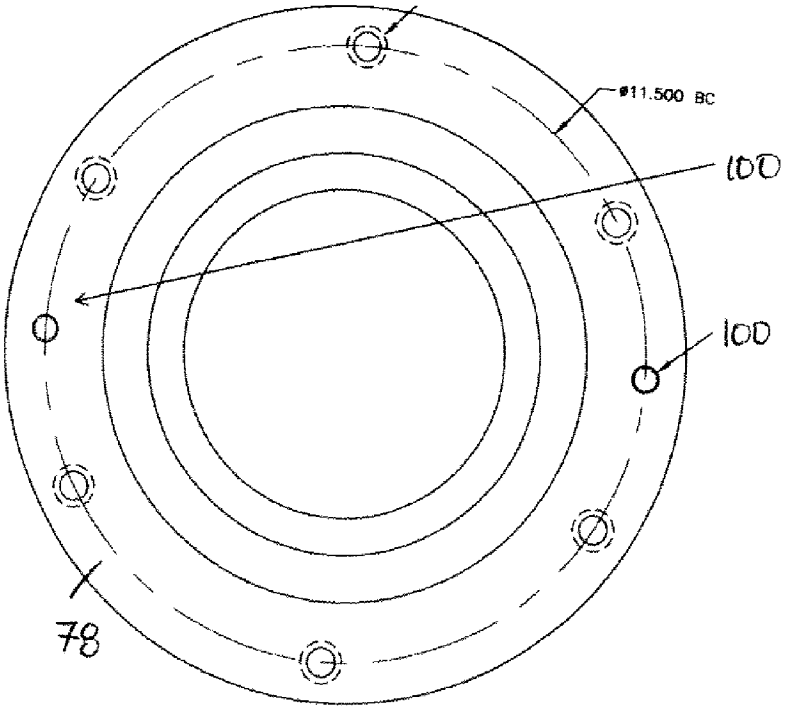
FIG. 11B shows a top view of an example embodiment of a seal plate.
Figure 11C:
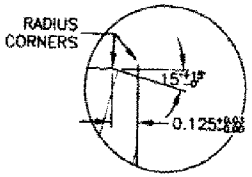
FIG. 11C shows a corner detail of an example embodiment of a seal plate.
Figure 11A:
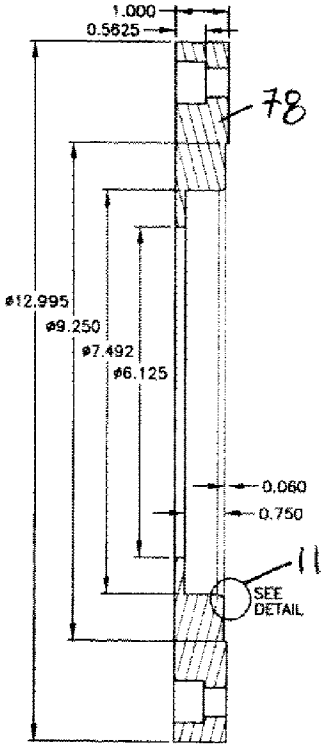
FIG. 11A shows a side cross sectional view of an example embodiment of a seal plate.

FIG. 11A shows a side cross sectional view of a seal plate 78, manufactured of stainless steel, drilled and tapped ½"×13 in two places to receive jacking bolts to facilitate easy removal of the seal plate. FIG. 11B shows a top view of the seal plate 78. FIG. 11C is a detail of the region 11 shown in FIG. 11A. The seal plate 78 and bearing bore 76 (FIG. 10A) are of dissimilar metals and may be subject to bonding. The pre-drilled and tapped jacking bolt bores 100 facilitate ease of removal of the seal plate 78 from roller 22 for bearing inspection, refurbishment or renewal. The present invention includes two drill and tapped jacking bores 100 to receive jacking bolts. The prior art does not use a roller tube cartridge assembly on the roller ends.

Figure 12B:
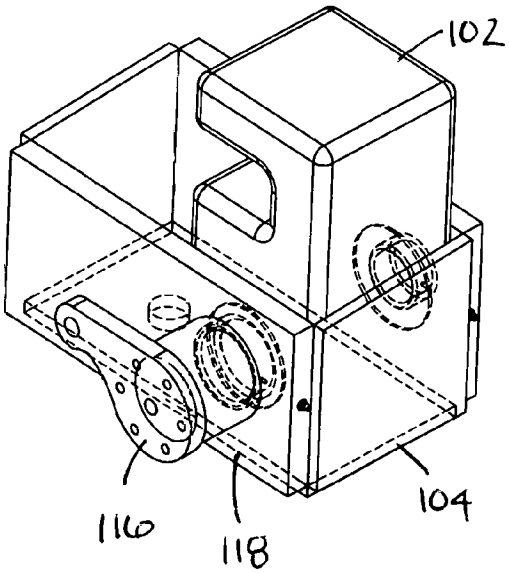
FIG. 12B shows an isometric view of an example embodiment of a tow hook assembly.
Figure 12A:
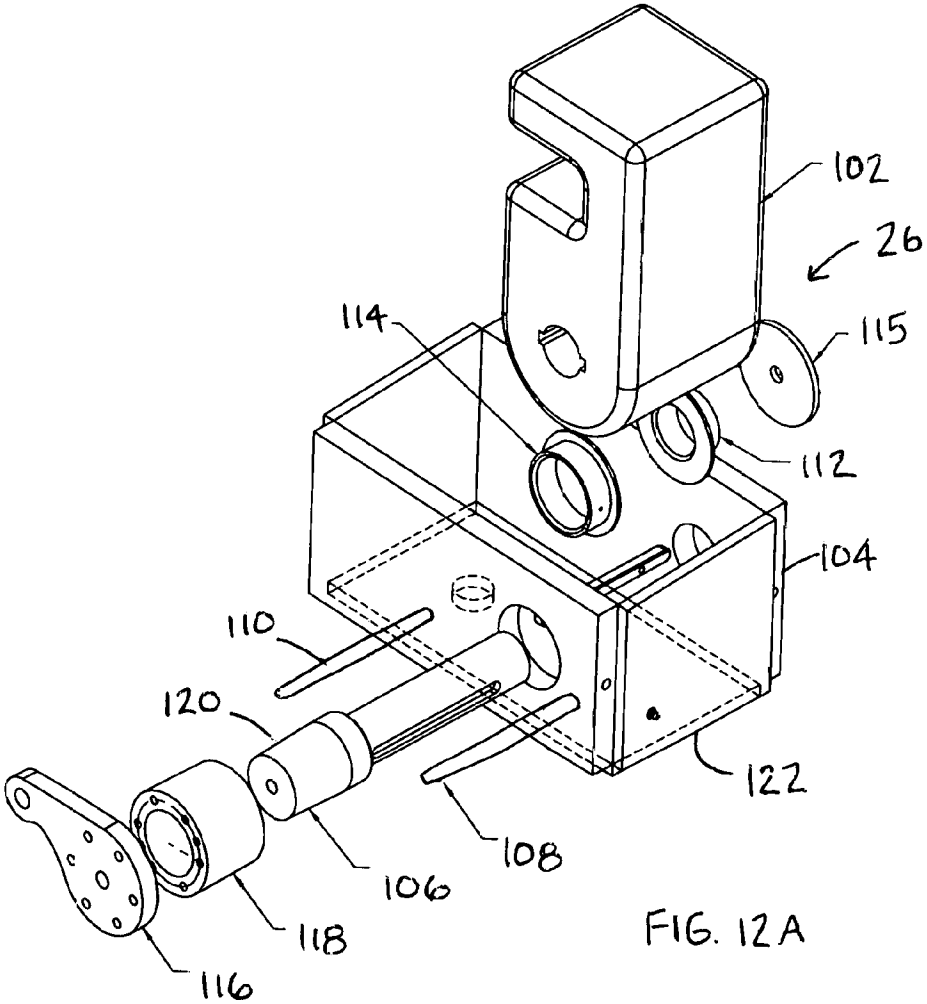
FIG. 12A shows an exploded view of an example embodiment of a tow hook assembly.
Figure 12S:
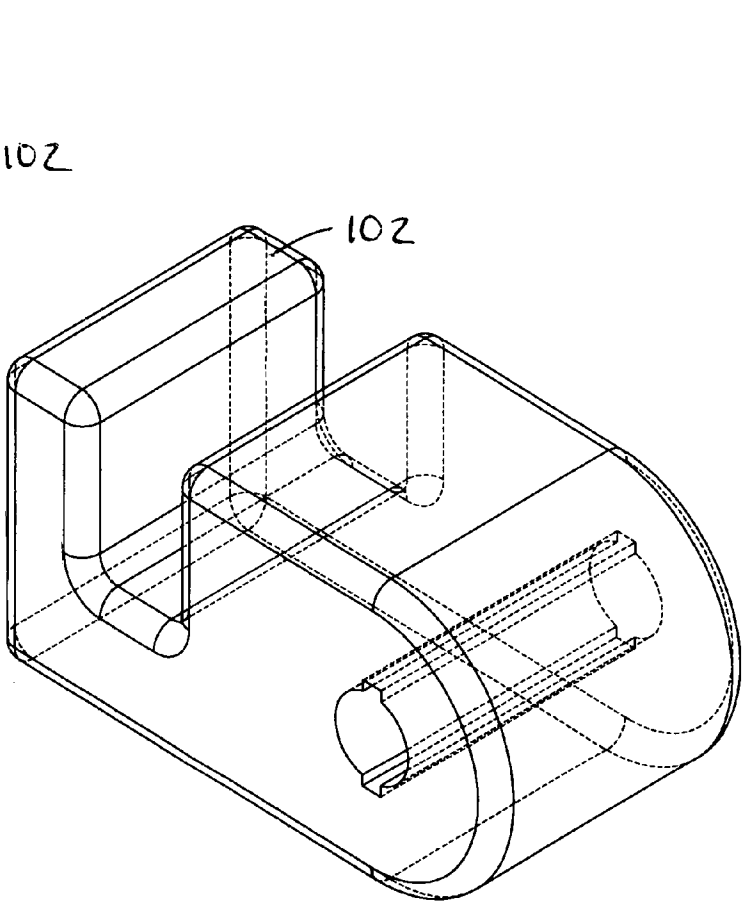
FIG. 12S shows an isometric view of an example embodiment of a tow hook assembly hook.
Figure 12Q:
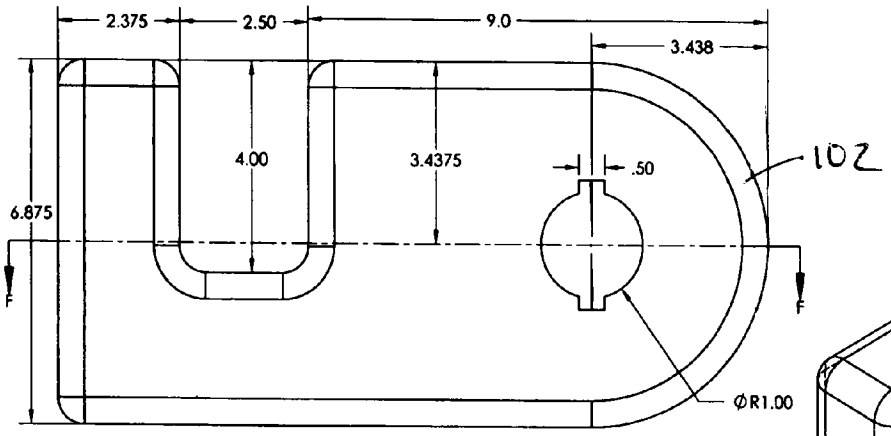
FIG. 12Q shows a side view of an example embodiment of a tow hook assembly hook.
Figure 12R:
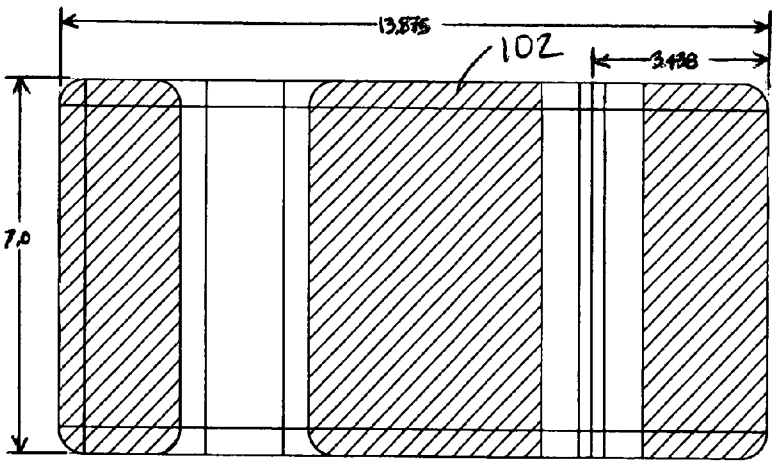
FIG. 12R shows a cross sectional plan view of an example embodiment of a tow hook assembly hook.
Figures 12T, 12U, 12V, 12W:
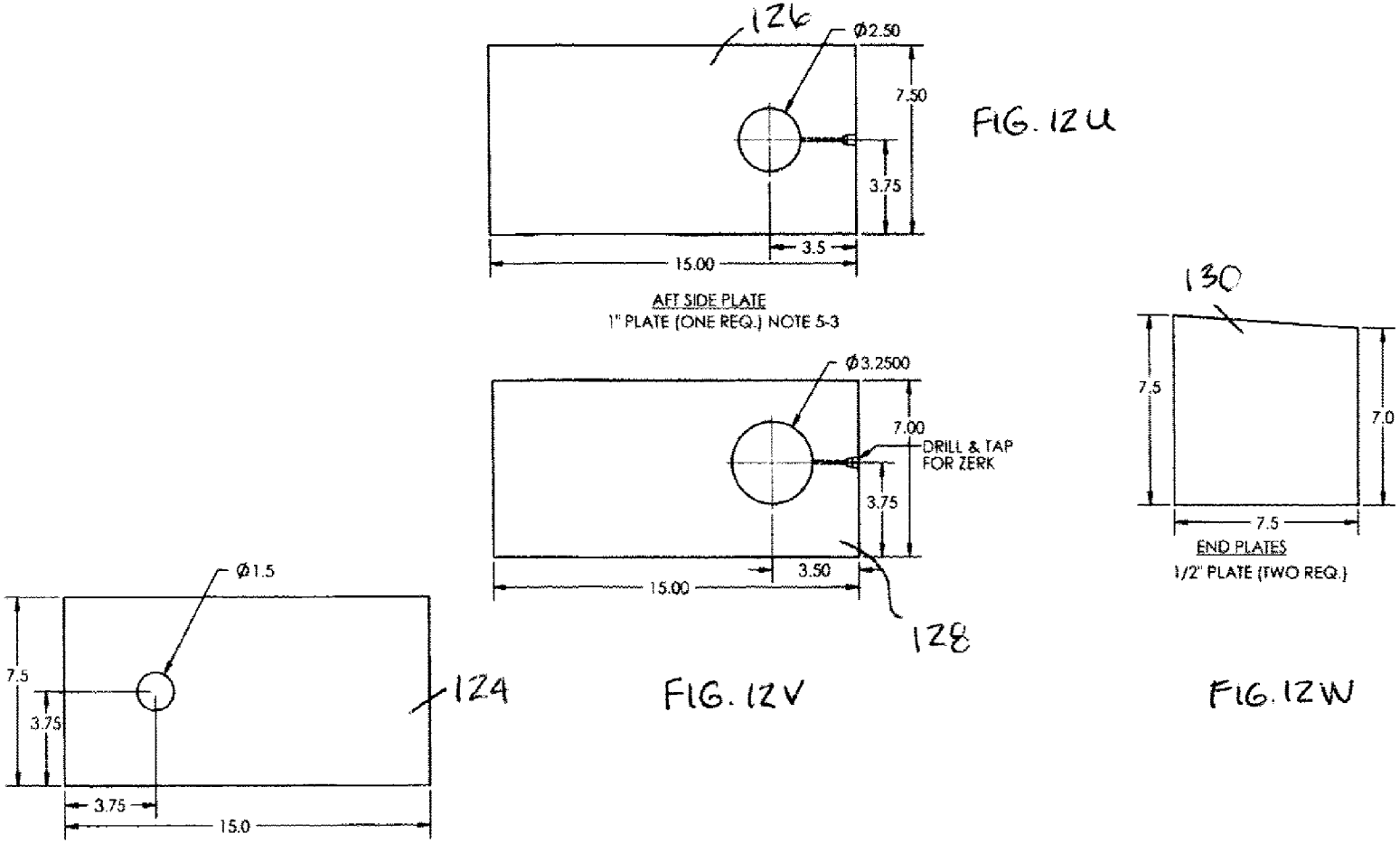
FIG. 12T shows a plan view of an example embodiment of a tow hook assembly bottom plate.
FIG. 12U shows a side view of an example embodiment of a tow hook assembly aft side plate.
FIG. 12V shows a side view of an example embodiment of a tow hook assembly forward side plate.
FIG. 12W shows a rear view of an example embodiment of a tow hook assembly end plate.

FIG. 12A shows an exploded view of a tow hook assembly 26. The tow hook assembly 26 is the component that restricts the tow wire's 16 (FIG. 1) vertical movement. It must have the structural integrity and design principles to withstand the same dynamic loading and salt water exposure that the affects the tow pins and roller. The hook assembly 26 is subject to heavy horizontal and vertical loads. The hook 102 is retracted (in this embodiment, retracted means hook 102 is lowered into tow box 28) when the towing operation requires an unobstructed horizontal movement of the tow wire and is raised out of tow box 28 when the towing operation requires trapping the wire 16 from movement. When the hook 102 is fully raised the backside rests against the hook box 104 adding additional strength to the assembly. The present invention utilizes the same cartridge principle for the tow hook as applied to the tow pins and roller.

The tow hook assembly 26 consists of a steel fabricated hook 102 mounted in a steel fabricated box 104. The present invention uses a tapered shaft 106 that defines a shaft axis 107 about which the shaft rotates. The shaft 106 is double keyed to two keys 108 and 110 for structural strength when inserted in the hook. The shaft 106 is tapered on one end and mounted in the box by a small bushing 112 on one end and a large bushing 114 on the other and an end plate 115. The tow hook 102 is rotated up and down by the action of the arm 116 bolted to the hub 118 which is subsequently pressed onto the tapered end 120 of the shaft. The throw of the arm can be precisely adjusted during manufacturing due to the tapered fit of the hub on the shaft. The arm is moved up and down by a hydraulic cylinder 122 (shown schematically) mounted inside the tow pin box. Hook box 104 includes side plate 124, 126, 128 and 130 (FIGS. 12T, 12U, 12V and 12W).

The prior art does not utilize a cartridge principle. The prior art box is integral to the pin box, the shaft is keyed on one side only, bushings are of equal diameter and the arm/hub assembly is welded to the shaft. Once the prior art tow hook assembly is installed, the entire assembly must be cut out of the pin box to service the tow hook components. The present invention's tow hook assembly 26 is a self-contained component of the tow pin assembly and creates an easier and more precise manufacturing process and allows ease of removal for inspection and refurbishment. During manufacturing the box 104 is welded into the tow pin box 28 and can be adjusted to accommodate different vertical wire fleeting angles (the angle created as a result of the tow winch height and distance from the tow pin assembly).

A steel fabricated box 104 is welded into pin box 28 (FIG. 4B) after tow pin box 28 is installed in vessel. The advantage is that the hook height can be adjusted by moving the hook box 104 up or down prior to final welding in place within tow pin box 28. This facilitates the performance of the hook 102 by customizing the design to accommodate different wire vertical fleeting angles and to allow ease of the tow wire entry into the hook during use. The prior art does not use a fabricated box component. The prior art tow hook box is integral to the tow pin box and its position cannot be adjusted during installation.

The tow hook shaft 106 of the present invention includes two key slots 109 and 111 so as to receive two keys 108, 110, in order to increase its structural strength. The hook 102 is subject to heavy horizontal loads in the raised position and the two keys prevent the hook from rotating on the shaft when in a fixed position. The prior art shaft is single keyed with half the structural connection as the present art. It is less durable and more subject to wear allowing the hook to rotate on the shaft.

The tow hook shaft 106 is of different diameters on either end. The larger end is fitted with a machined taper to accept a larger bushing 114 and the pressed on hub 118. The opposite end is of a smaller diameter to accept the smaller bushing 112 and the keys 108 and 110. The advantage of the present invention is that is that the key 108, 110, can be easily removed through the larger bushing side and the shaft, hook and bushings can be removed without altering the pin box structure. Any of the hook components can be replaced without damaging the hook box 104 and the hook 102 can be removed and new bushings inserted into the hook receiver. The prior art has equal diameters on its shaft and once exposed to a salt water environment, the shaft cannot be removed due salt water corrosion. Instead the entire tow pin assembly of the prior art must be cut out of the pin box and must be scraped and replaced with a new assembly.

In summary, the tow pin assembly 10 is subject to heavy use in extreme environmental conditions. Components of the tow pin assembly 10 are subject to wear and require refurbishment or renewal at different times during the life of the assembly. The prior art uses materials and a design which make the tow pin assembly more subject to corrosive processes and require extensive disassembly to replace critical components. The disassembly process of the prior art regularly includes the destruction of unaffected surrounding components and structure in order to access and remove the worn component.

The present invention utilizes a cartridge principle in the design and manufacturing of a tow pin assembly 10 that is not found in the prior art. The major components of the tow pin assembly, including tow pins 24 in a self contained tow pin cartridge 56, stern roller 22 in a self contained horizontal roller cartridge 76, and tow hook 102 in a self contained tow hook cartridge 104, are designed and manufactured as a cartridge independent of the other components and the supporting structure of the tow pin box 28. The present invention uses a "cartridge" design principle which enables individual components to be removed for refurbishment or renewal without the extensive disassembly required of the prior art. Components requiring repair or renewal can be removed and installed without damaging or disassembling the other components.

In addition the present invention uses ball bearings, stainless steel rather than mild steel as used by prior art, for critical components in order to reduce corrosive processes and facilitate ease of assembly and disassembly and provide superior performance and longevity over prior art. Prior art life expectancy is 5-7 years and requires complete replacement of the tow pin assembly. The present invention allows replacement of components and has a life expectancy of 10-15 years.

I claim:

1. A tow pin assembly, comprising:

a tow pin assembly housing including therein a horizontal roller assembly, a vertical pin assembly, and a hook assembly each separately removably positioned within said tow pin assembly housing;

said horizontal roller assembly including a horizontal roller mounted within a horizontal roller assembly housing, said horizontal roller mounted on a horizontal rotation axis for rotation there around such that said horizontal roller extends at least partially outwardly of said horizontal roller assembly housing, said horizontal roller assembly housing removable from said tow pin assembly housing with an absence of contact with said vertical pin assembly and said hook assembly;

said vertical pin assembly including a vertical roller mounted within a vertical pin assembly housing, said vertical roller movable between an actuated position wherein said vertical roller is positioned at least partially extending outwardly of said vertical pin assembly housing and a retracted position wherein said vertical roller is positioned completely inwardly of said vertical pin assembly housing, said vertical pin assembly housing removable from said tow pin assembly housing with an absence of contact with said horizontal roller assembly and said hook assembly; and said hook assembly including a hook mounted within a hook assembly housing, said hook movable between an actuated position wherein said hook is positioned at least partially extending outwardly of said hook assembly housing and a retracted position wherein said hook is positioned completely inwardly of said hook assembly housing, said hook assembly housing removable from said tow pin assembly housing with an absence of contact with said horizontal roller assembly and said vertical pin assembly.

2. The assembly of claim 1 wherein said horizontal roller assembly housing includes a front seal plate and a back seal plate secured on a bearing insert to define a bearing cavity therein, a plurality of bearings positioned within said bearing cavity of said bearing insert, said plurality of bearings positioned around an axel shaft secured to said tow pin assembly housing, and said horizontal roller mounted on said bearing insert.

3. The assembly of claim 2 wherein said axel shaft defines said horizontal rotational axis of said horizontal roller.

4. The assembly of claim 2 wherein said horizontal roller assembly housing further includes an axel shaft seal positioned on said front seal plate and around said axel shaft, said axel shaft further including a central channel that defines a grease path for inserting grease into said bearing cavity, said axel shaft seal preventing grease from exiting said bearing cavity through said front seal plate.

5. The assembly of claim 2 wherein said axel shaft is mounted on a flange plate, and said flange plate is removably secured to said tow pin assembly housing.

6. The assembly of claim 1 wherein said vertical pin assembly housing includes a cylindrical shaped roller bearing, said vertical roller mounted on said cylindrical shaped roller bearing.

7. The assembly of claim 6 wherein said vertical pin assembly housing includes a ball bearing cage having a plurality of ball bearings positioned therein, said vertical roller mounted on said plurality of ball bearings.

8. The assembly of claim 7 wherein said vertical pin assembly housing includes an outer tube mounted on a bottom plate, a hydraulic ram mounted on said bottom plate, a roller top plate mounted on said hydraulic ram opposite said bottom plate, a cylindrical shaped vertical roller support secured to said roller top plate, said cylindrical shaped roller bearing and said ball bearing cage both mounted on an exterior of said cylindrical shaped vertical roller support.

9. The assembly of claim 8 wherein said outer tube of said vertical pin assembly housing is removably secured to said tow pin assembly housing.

10. The assembly of claim 7 wherein said outer tube includes a slotted keyway, said cylindrical shaped vertical roller support includes a key extending outwardly there from and movably received within said slotted keyway of said outer tube such that said slotted keyway guides vertical movement of said cylindrical shaped vertical roller support within said outer tube.

11. The assembly of claim 1 wherein said hook assembly housing includes a hook housing having a shaft extending there through, first and second keys each received within a key slot of said shaft, a hook mounted on said shaft and said first and second keys, and an arm mounted on said shaft, said arm actuatable to turn said shaft about a shaft axis which simultaneously moves said hook from a retracted position within said hook housing to an extended positioned extending outwardly from said hook housing.

12. The assembly of claim 11 wherein said shaft includes a first end region extending outwardly from said hook, said first end region of said shaft defining a tapered exterior surface, said hook assembly further including a hub having a tapered interior surface that mates with said tapered exterior surface of said first end region of said shaft, said arm secured to said hub, wherein said hub is adjustably positioned on said tapered exterior surface to define a predetermined throw of said arm.

13. The assembly of claim 11 wherein said hook assembly housing is removably secured to said tow pin assembly housing.

14. A marine vessel towing assembly, comprising:

a tow pin assembly housing including therein a self-contained horizontal roller cartridge, a self-contained vertical pin cartridge, and a self-contained hook cartridge, said tow pin assembly housing defining a clear path of removal for each self-contained cartridge from said tow pin assembly housing such that removal of each self-contained cartridge is conducted with an absence of contact with remaining self-contained cartridges of said tow pin assembly housing; and a fairlead structure for moving a towing wire from a retracted to a towing position, a tow wire secured to said fairlead structure and in said towing position extending through a hook of said hook cartridge, through a plurality of vertical pins of said vertical pin cartridge, and over a horizontal roller of said horizontal roller cartridge.

15. The assembly of claim 14 wherein said horizontal roller cartridge comprises a bearing insert mounted on an axel shaft, said axel shaft removably secured to said tow pin assembly housing, and a horizontal roller mounted on said bearing insert, said vertical pin cartridge comprises an outer tube secured to a bottom plate, said bottom plate removably secured to said tow pin assembly housing, a pin movably mounted on said bottom plate, a bearing and a ball bearing cage mounted on said pin, and a vertical roller mounted on said bearing and said ball bearing cage, and said hook cartridge comprises a hook housing removably secured to said tow pin assembly housing and having a shaft rotatably positioned therein, a hook and an arm mounted on said shaft such that movement of said arm causes movement of said hook into and out of said hook housing.

16. A method of manufacturing a marine vessel towing assembly, comprising:

providing a towing assembly housing;

removably mounting a vertical roller cartridge on said towing assembly housing, said vertical roller cartridge including a vertical roller that provides a rotating vertical surface for movement of a towing wire there over;

removably mounting a horizontal roller cartridge on said towing assembly housing, said horizontal roller cartridge including a horizontal roller that provides a rotating horizontal surface for movement of a towing wire there over; and removably mounting a hook cartridge on said towing assembly housing, said hook cartridge including a hook that provides a capture path for movement of a towing wire there through, wherein each of said cartridges is removable from said towing assembly housing with an absence of damage to cartridges remaining in said towing assembly housing.

17. The method of claim 16 wherein removably mounting said vertical roller cartridge on said towing assembly housing includes securing a bottom plate of said vertical roller cartridge to said towing assembly housing, wherein a movable pin is secured to said bottom plate, a bearing and a ball bearing cage are mounted on said movable pin, and said vertical roller is mounted on said bearing and said ball bearing cage.

18. The method of claim 16 wherein removably mounting said horizontal roller cartridge on said towing assembly housing includes securing an axel shaft of said horizontal roller cartridge to said towing assembly housing, wherein bearings are mounted on said axel shaft and are secured within a bearing insert, and said horizontal roller is mounted on said bearing insert.

19. The method of claim 16 wherein removably mounting said hook cartridge on said towing assembly housing includes securing a hook box of said hook cartridge to said towing assembly housing, wherein a shaft having a tapered end region extends through said hook box, said hook is secured to said shaft, an arm is adjustable secured on said tapered end region of said shaft, and wherein movement of said arm causes movement of said hook between a stowed position within said hook box and a retracted position partially outwardly of said hook box.

* * * * *